US011161716B2

(12) United States Patent
Fauconnet et al.

(10) Patent No.: US 11,161,716 B2
(45) Date of Patent: Nov. 2, 2021

(54) ELEVATOR CAR TOE GUARD SYSTEM

(71) Applicant: Otis Elevator Company, Farmington, CT (US)

(72) Inventors: Aurelien Fauconnet, Isdes (FR); Joachim Angoulevant, St. Martin d'Abbat (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 313 days.

(21) Appl. No.: 16/282,585

(22) Filed: Feb. 22, 2019

(65) Prior Publication Data

US 2019/0263630 A1 Aug. 29, 2019

(30) Foreign Application Priority Data

Feb. 23, 2018 (EP) ..... 18305189

(51) Int. Cl.
*B66B 13/28* (2006.01)
*B66B 5/28* (2006.01)

(52) U.S. Cl.
CPC ..... *B66B 13/285* (2013.01); *B66B 5/284* (2013.01)

(58) Field of Classification Search
CPC ..... B66B 5/284; B66B 5/286; B66B 13/285
See application file for complete search history.

(56) References Cited

U.S. PATENT DOCUMENTS 8,356,699 B2 1/2013 Rasanen et al.
9,227,817 B2 1/2016 Fauconnet et al.
2003/0217895 A1* 11/2003 Kigawa ..... B66B 5/282 187/344
2007/0181377 A1* 8/2007 Ketonen ..... B66B 13/285 187/314
2008/0302612 A1* 12/2008 Beauchaud ..... B66B 5/0062 187/344
2014/0008158 A1* 1/2014 Fauconnet ..... B66B 13/285 187/400

(Continued)

FOREIGN PATENT DOCUMENTS

CN 101472830 A 7/2009
CN 201447287 U 5/2010
CN 201512341 U 6/2010

(Continued)

OTHER PUBLICATIONS

"Okatt Apron for Low Pit", YouTube video, available at: https://www.youtube.com/watch?v=J3LIQcuKeaY&feature=youtu.be, accessed Feb. 21, 2019, published Sep. 3, 2015, by AGUI (2 pages).

(Continued)

*Primary Examiner* — Minh Truong
(74) *Attorney, Agent, or Firm* — Cantor Colburn LLP

(57) ABSTRACT

Elevator toe guard assemblies are provided. The elevator toe guard assemblies include an elevator car frame, a buffer located within an elevator shaft, and a toe guard mounted to the elevator car frame. The toe guard has a first state being a fully extended state, a second state wherein the toe guard does not contact a pit floor during operation of an elevator car, and a third state wherein at least a portion of the toe guard is moved relative to the elevator car frame during an impact between the buffer and the pit floor.

18 Claims, 7 Drawing Sheets

(56) References Cited

U.S. PATENT DOCUMENTS

| | | | | |
|---|---|---|---|---|
| 2014/0216860 | A1* | 8/2014 | Karimpanackal Natarajan | B66B 13/285 187/400 |
| 2016/0122159 | A1 | 5/2016 | Delachatre et al. | |

FOREIGN PATENT DOCUMENTS

| | | | | | |
|---|---|---|---|---|---|
| CN | 102120542 | A | | 7/2011 | |
| CN | 102120542 | A | * | 7/2011 | B66B 13/285 |
| CN | 102196985 | A | | 9/2011 | |
| CN | 202201594 | U | | 4/2012 | |
| CN | 202414934 | U | | 9/2012 | |
| CN | 103407858 | A | | 11/2013 | |
| CN | 102701057 | B | | 4/2014 | |
| CN | 203781599 | U | | 8/2014 | |
| CN | 204162218 | U | | 2/2015 | |
| CN | 204251156 | U | | 4/2015 | |
| CN | 204280943 | U | | 4/2015 | |
| CN | 204280981 | U | | 4/2015 | |
| CN | 204823596 | U | | 12/2015 | |
| CN | 204958077 | U | | 1/2016 | |
| CN | 105314495 | A | | 2/2016 | |
| CN | 103562110 | B | | 7/2016 | |
| CN | 105775949 | A | | 7/2016 | |
| CN | 106081804 | A | | 11/2016 | |
| CN | 104627792 | B | | 2/2017 | |
| CN | 106379799 | A | | 2/2017 | |
| CN | 206521182 | U | | 9/2017 | |
| DE | 10052459 | A1 | | 5/2002 | |
| DE | 202006007666 | U1 | | 10/2007 | |
| DE | 202011051638 | U1 | * | 11/2011 | B66B 5/0081 |
| EP | 1215159 | A2 | | 6/2002 | |
| EP | 1118576 | B1 | | 4/2005 | |
| EP | 1753689 | B1 | | 2/2007 | |
| EP | 1781563 | B1 | | 5/2007 | |
| EP | 1854758 | A1 | | 11/2007 | |
| EP | 1914190 | A1 | | 4/2008 | |
| EP | 2039644 | A1 | | 3/2009 | |
| EP | 1772414 | B1 | | 5/2009 | |
| EP | 2138443 | A1 | | 12/2009 | |
| EP | 1730068 | B1 | | 5/2010 | |
| EP | 2308789 | B1 | | 4/2011 | |
| EP | 2094597 | B1 | | 1/2015 | |
| EP | 3012218 | B1 | | 2/2017 | |
| EP | 2782861 | B1 | | 7/2017 | |
| EP | 3257803 | A | | 12/2017 | |
| JP | H05162946 | A | | 6/1993 | |
| TW | 513372 | B | | 12/2002 | |
| WO | 32060802 | A2 | | 8/2002 | |
| WO | 2008110696 | A1 | | 9/2008 | |
| WO | 2012127269 | A1 | | 9/2012 | |
| WO | 2013054321 | A1 | | 4/2013 | |
| WO | WO-2013057362 | A1 | * | 4/2013 | B66B 13/285 |
| WO | 2014195751 | A1 | | 12/2014 | |

OTHER PUBLICATIONS

Elevator Equipment Limited: Three Part Telescopic Car Apron/Toe Guard. URL: https://www.elevatorequipment.co.uk/car-equipment/telescopic-solid-car-aprons/three-part-telescopic-car-apron-toe-guard; Accessed On: Feb. 21, 2019.

European Search Report for European Application No. 18305189, International Filing Date Feb. 23, 2018, dated Sep. 24, 2018, 8 pages.

* cited by examiner

ELEVATOR CAR TOE GUARD SYSTEM

CROSS REFERENCE TO RELATED APPLICATIONS

This application claims the benefit of European Application No. 18305189.5, filed Feb. 23, 2018, which is incorporated herein by reference in its entirety.

BACKGROUND

The subject matter disclosed herein generally relates to elevator systems and, more particularly, to elevator car toe guards and buffers for elevator systems.

Traditional safety requirements for elevator shafts have led to larger spaces both at the top and bottom of the elevator shaft. However, such enlarged spaces may be disadvantageous for architectural reasons. Thus, elevator lift manufacturers have attempted to reduce hoistway or elevator shaft overhead dimensions and pit depth while maintaining safety features. The two dimensions (overhead dimension and pit depth, also referred to collectively as safety volumes) are key characteristics for elevator construction and design. Mechanics currently go to the top of car, or on top thereof, or in the pit, for inspection or maintenance activity of various components of an elevator car system. Thus, safety spaces or volumes are employed within the elevator shaft to protect a mechanic in the event of an emergency and thus require increased overhead and pit dimensions. The safety volumes of an elevator shaft may impact the dimensions and construction of a building that houses the elevator.

The required dimensions of the safety volumes on the top of the car and in the pit may be increased to provide more safety to technicians located in either safety volume during maintenance, inspection, etc. Accordingly, the hoistway dimensions may be increased, which may not be desirable for overall building construction and design.

The dimensions in the pit may be provided for access to the underside of an elevator car to enable inspection and maintenance by a technician of various components installed thereon and/or components located within the pit. Buffers are devices configured to soften the force with which an elevator runs into a pit (e.g., floor) of an elevator shaft during an emergency. Buffers are safety devices/components that are configured in terms of an ability to decelerate or stop an elevator car in the event of an emergency and thus may require regular inspection and/or maintenance to maintain proper operation. Buffers may be located on the bottom of an elevator car or located within the pit of the elevator hoistway. The buffers installed in the hoistway may be spring buffers and/or hydraulic/oil buffers, or other types of buffers, which are installed in the pit of an elevator shaft. These buffers are fixed to the floor or surface of the pit and are configured to impact a bottom surface of an elevator car. Buffers installed on an elevator car are configured to reduce or minimize impacts during an emergency by impacting the floor or a surface of the pit of the elevator shaft.

Moreover, elevator cars typically include a toe guard situated beneath the elevator car door. The toe guard is typically rigid and with a nominal height of about 750 mm. A significant amount of clearance beneath the elevator car is required to avoid contact between the toe guard and the bottom of the elevator shaft when the elevator car is situated at a lowest landing. Such contact could cause significant damage to the toe guard due to the rigid and fixed nature of the toe guard. Accordingly, retractable toe guards have been proposed to address the above issues. However, improved systems may be advantageous.

SUMMARY

According to some embodiments, elevator toe guard assemblies are provided. The elevator toe guard assemblies include an elevator car frame, a buffer located within an elevator shaft, and a toe guard mounted to the elevator car frame. The toe guard has a first state being a fully extended state, a second state wherein the toe guard does not contact a pit floor during operation of an elevator car, and a third state wherein at least a portion of the toe guard is moved relative to the elevator car frame during an impact between the buffer and the pit floor.

In addition to one or more of the features described above, or as an alternative, further embodiments of the elevator toe guard assemblies may include that the toe guard comprises a first element and at least one second element, wherein the at least one second element is moveable during the impact between the buffer and the pit floor.

In addition to one or more of the features described above, or as an alternative, further embodiments of the elevator toe guard assemblies may include that the first element is fixedly connected to the elevator car frame.

In addition to one or more of the features described above, or as an alternative, further embodiments of the elevator toe guard assemblies may include that the at least one second element comprises a plurality of second elements forming a telescopic toe guard.

In addition to one or more of the features described above, or as an alternative, further embodiments of the elevator toe guard assemblies may include that the at least one second element comprises a plurality of second elements forming a folding toe guard.

In addition to one or more of the features described above, or as an alternative, further embodiments of the elevator toe guard assemblies may include a sliding mount, wherein at least one second element is slidably mounted to at least one of the elevator car frame and the first element by the sliding mount.

In addition to one or more of the features described above, or as an alternative, further embodiments of the elevator toe guard assemblies may include at least one structural support arranged to support at least one second element when the toe guard is in the first state.

In addition to one or more of the features described above, or as an alternative, further embodiments of the elevator toe guard assemblies may include that, when in the first state, the toe guard extends at least 750 mm from the elevator car frame.

In addition to one or more of the features described above, or as an alternative, further embodiments of the elevator toe guard assemblies may include that when in the second state, the toe guard extends about 280 mm from the elevator car frame.

In addition to one or more of the features described above, or as an alternative, further embodiments of the elevator toe guard assemblies may include that when in the second state, the toe guard maintains a minimum clearance distance between the toe guard and the pit floor.

In addition to one or more of the features described above, or as an alternative, further embodiments of the elevator toe guard assemblies may include that the minimum clearance distance is about 20 mm.

In addition to one or more of the features described above, or as an alternative, further embodiments of the elevator toe guard assemblies may include that the toe guard is about 180 mm in dimension when in the third state.

In addition to one or more of the features described above, or as an alternative, further embodiments of the elevator toe guard assemblies may include that the buffer is at least one of mounted to the elevator car frame and located proximate an elevator pit floor.

In addition to one or more of the features described above, or as an alternative, further embodiments of the elevator toe guard assemblies may include that the toe guard is manually operable from the second state to the first state.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
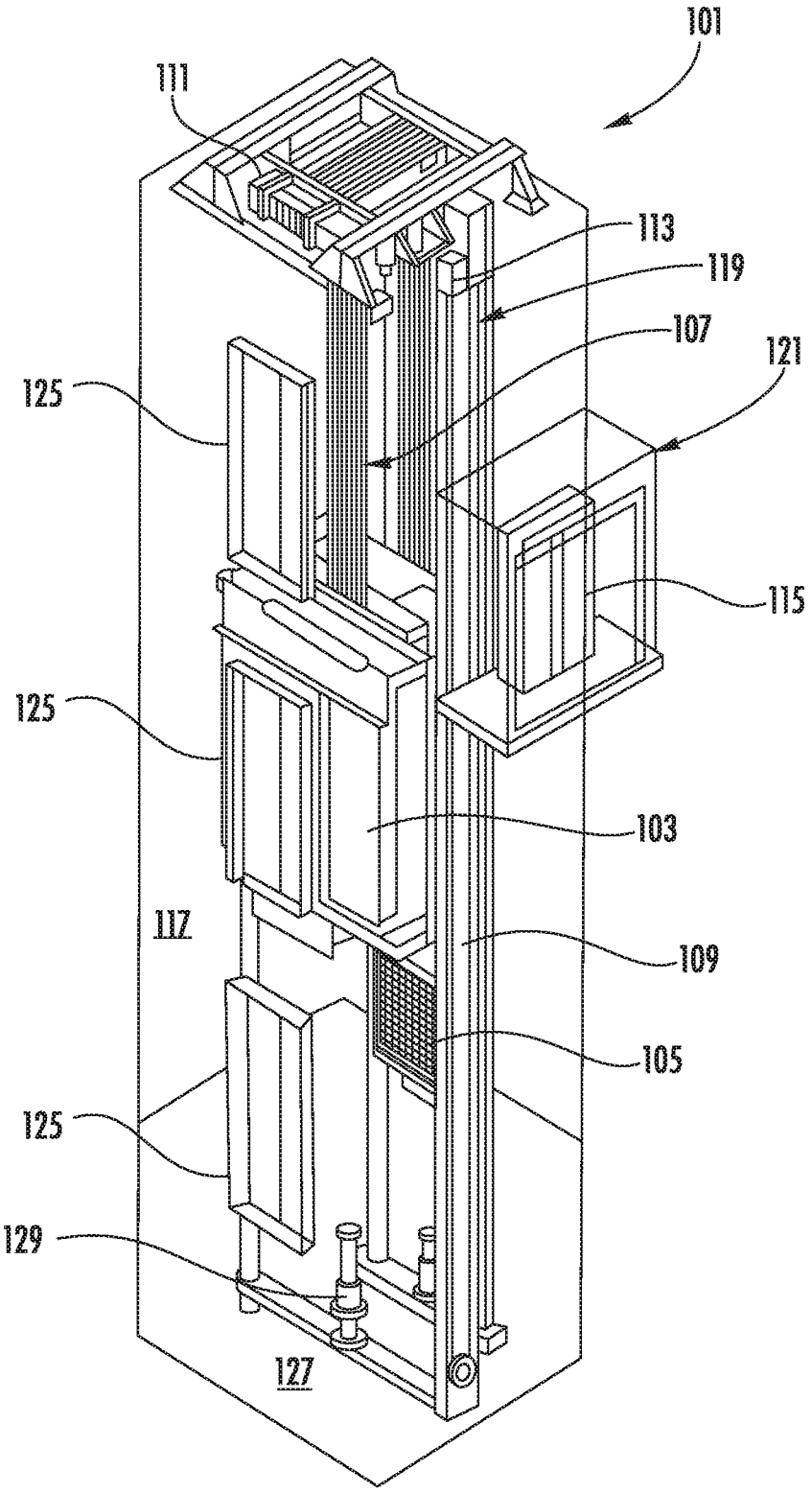
FIG. 1 is a schematic illustration of an elevator system that may employ embodiments of the disclosure.

FIG. 1 is a perspective view of an elevator system 101 including an elevator car 103, a counterweight 105, a roping 107, a guide rail 109, a machine 111, a position encoder 113, and a controller 115. The elevator car 103 and counterweight 105 are connected to each other by the roping 107. The roping 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The roping 107 engages the machine 111, which is part of an overhead structure of the elevator system 101. The machine 111 is configured to control movement between the elevator car 103 and the counterweight 105. The position encoder 113 may be mounted on an upper sheave of a speed-governor system 119 and may be configured to provide position signals related to a position of the elevator car 103 within the elevator shaft 117. In other embodiments, the position encoder 113 may be directly mounted to a moving component of the machine 111, or may be located in other positions and/or configurations as known in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position encoder 113. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor.

At the bottom of the elevator shaft 117, i.e., in pit 127, may be one or more buffers 129. The buffers 129 may be secured in the pit 127 of the elevator shaft 117, and may be secured to the guide rail 109, e.g., on a vertical portion or a horizontal portion of the guide rail 109, as shown in FIG. 1. The buffers 129 may be hydraulic or foam type buffers, as known in the art, or may take other configurations. The buffers 129 are configured to impact a bottom surface of the elevator car 103 in the event the elevator car 103 falls within the elevator shaft 117. In alternative non-limiting embodiments, the buffers 129 may be configured or fastened directly on or to a floor of the pit 127. In some configurations, as will be readily appreciated by those of skill in the art, the buffers may be affixed to the bottom of the elevator car 103 instead of or in addition to the pit buffers 129 shown in FIG. 1.

Although shown and described with a roping system, elevator systems that employ other methods and mechanisms of moving an elevator car within an elevator shaft may employ embodiments of the present disclosure. FIG. 1 is merely a non-limiting example presented for illustrative and explanatory purposes.

Figure 2:
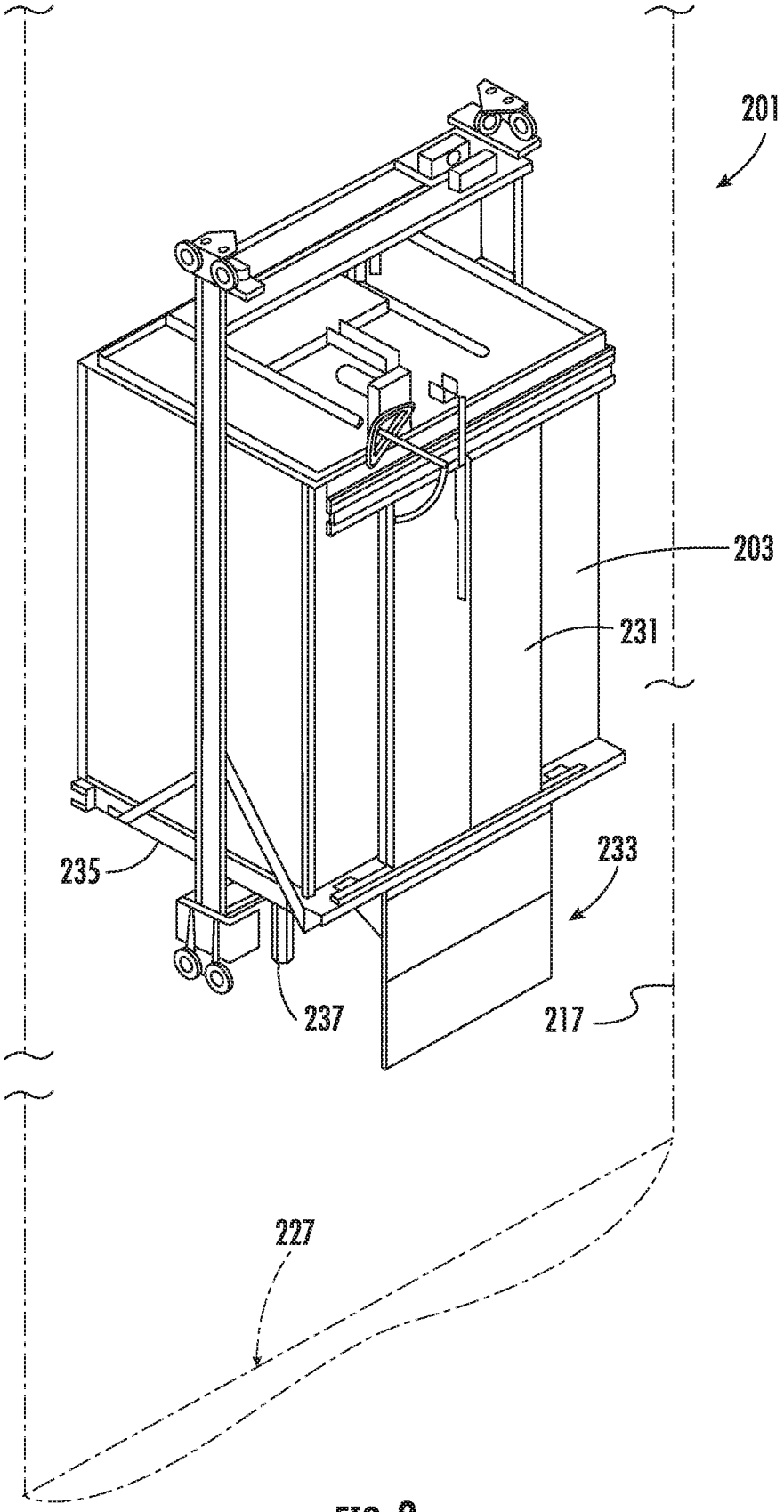
FIG. 2 is a schematic illustration of an elevator system that may employ embodiments of the present disclosure.

FIG. 2 is a schematic illustration of an elevator system 201 that can incorporate embodiments of the present disclosure. The elevator system 201 includes an elevator car 203 that is moveable within an elevator shaft 217. A pit 227 is shown at the bottom of the elevator shaft 217. The elevator car 203 includes doors elevator car doors 231 that open and close to allow ingress/egress to/from the elevator car 203 at one or more landings of the elevator system 201.

A toe guard assembly 233 is provided on the elevator car 203 to cover the space between a bottom 235 of the elevator car 203 and an adjacent landing, when the elevator car 203 is in the proximity of the landing. If, for any reason, the landing doors (not shown) were to open before the elevator car 203 is properly aligned with the landing, the toe guard assembly 233 is provided to at least partially block the open landing door. One function of the toe guard assembly 233 is to prevent people from falling in the elevator shaft 217 during rescue operations when the elevator car door 231 is not aligned with a landing door.

However, the presence of the toe guard assembly 233 impacts how close the elevator car 203 can get to the pit 227 of the elevator shaft 217. The example toe guard assembly 233 of the present embodiment is collapsible or movable between an extended state (shown in FIG. 2) and a retracted state (not shown) that allows the elevator car 203 to descend closer to the pit 227 than may otherwise be possible to if the toe guard assembly 233 remained in the extended state. That is, the dimensions of the toe guard assembly 233 in the retracted state are significantly less than the dimensions of the toe guard assembly 233 in an extended state.

As shown in FIG. 2, a car buffer 237 may be located on the bottom 235 of the elevator car 203. The car buffer 237 may be similar to the pit buffers shown in FIG. 1. The car buffer 237 is arranged to contact or impact the pit 227 prior to the bottom 235 of the elevator car 203 contacting or impacting the pit 227. The buffer 237 may be arranged to have a specific dimension based on the materials, structural features, elevator system requirements, safety requirements, etc., as will be appreciated by those of skill in the art.

Embodiments of the present disclosure are directed to elevator buffer and toe guard systems that operate in concert to provide safety and minimize damage to components to the elevator systems. For example, in some embodiments, toe guards of the present disclosure are adjustable between three states, a first state being fully extended to provide safety as described above, a second state being partially extended or partially retracted to prevent contact with the pit during normal operation and the elevator car is located at the lowest landing, and a third state being fully retracted during impact between a buffer of the elevator car and the pit.

Figure 3A:
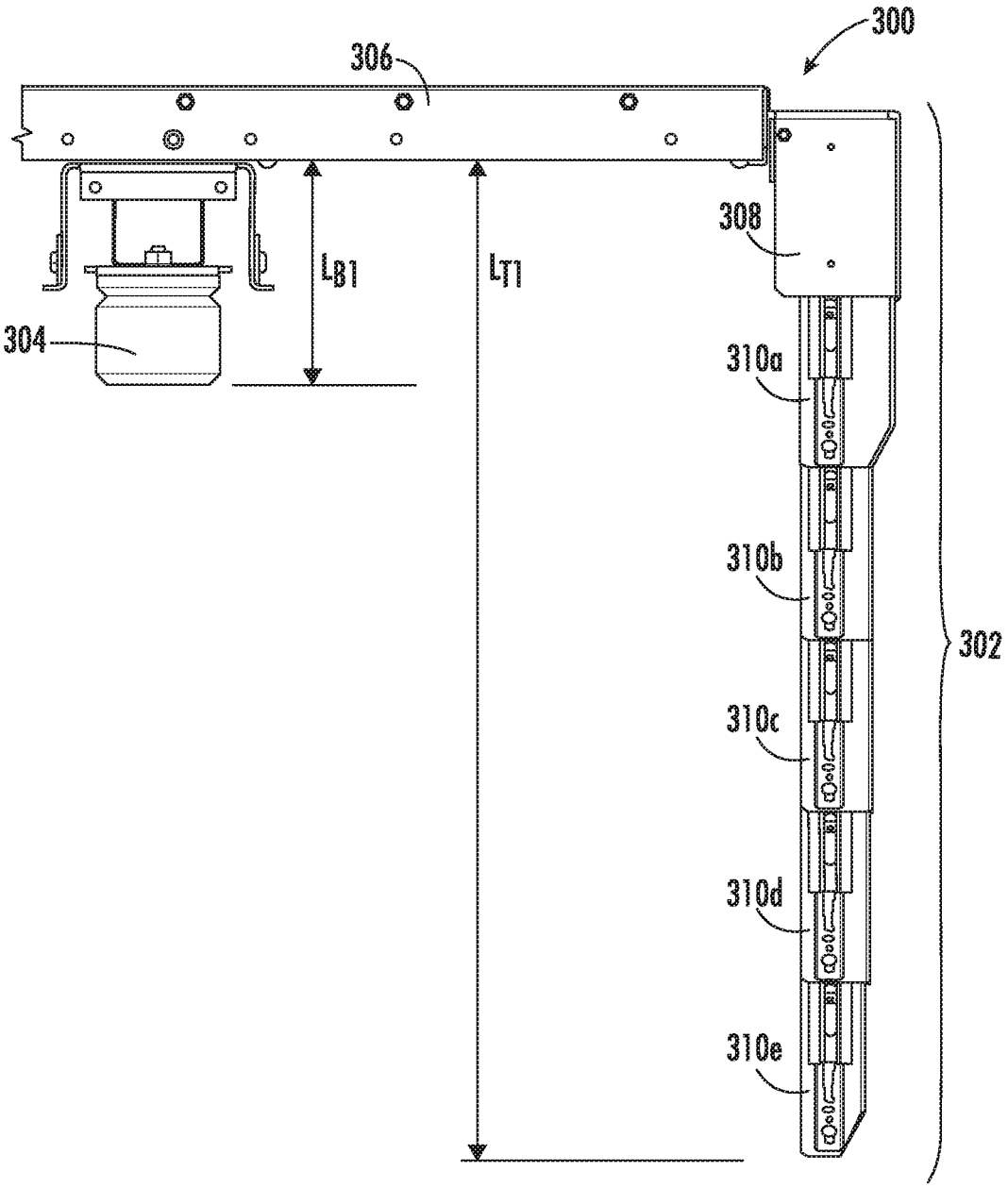
FIG. 3A is a schematic illustration of an elevator toe guard assembly in accordance with an embodiment of the present disclosure, shown in a first state.
Figure 3B:
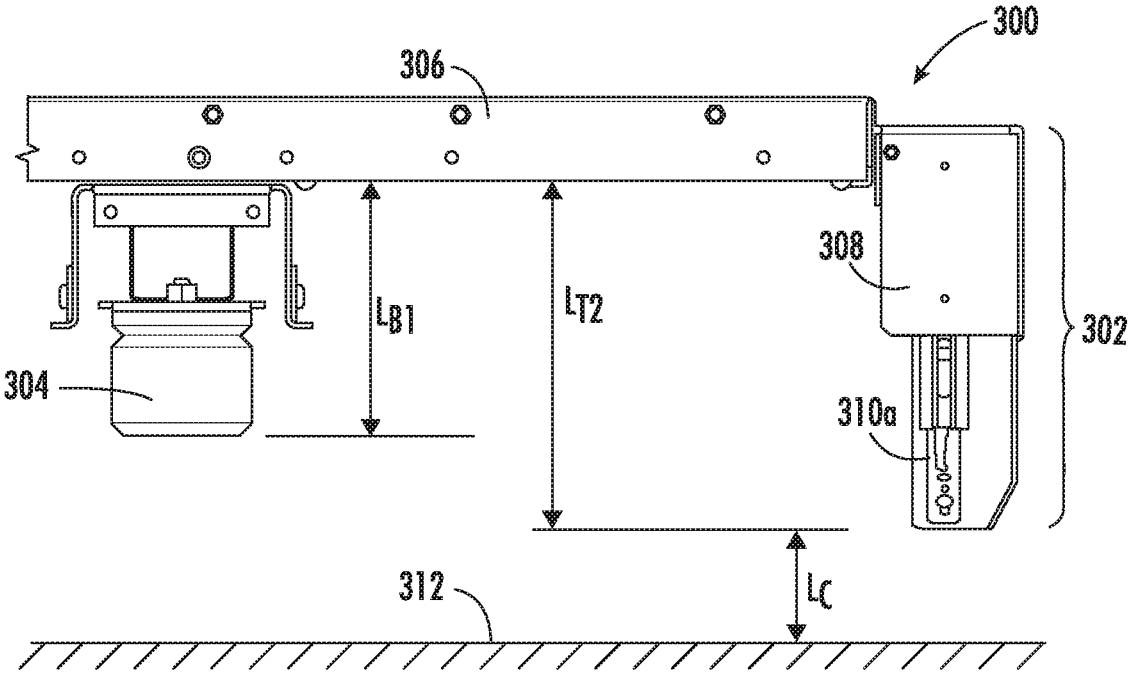
FIG. 3B is a schematic illustration of the elevator toe guard assembly of FIG. 3A shown in a second state.
Figure 3C:
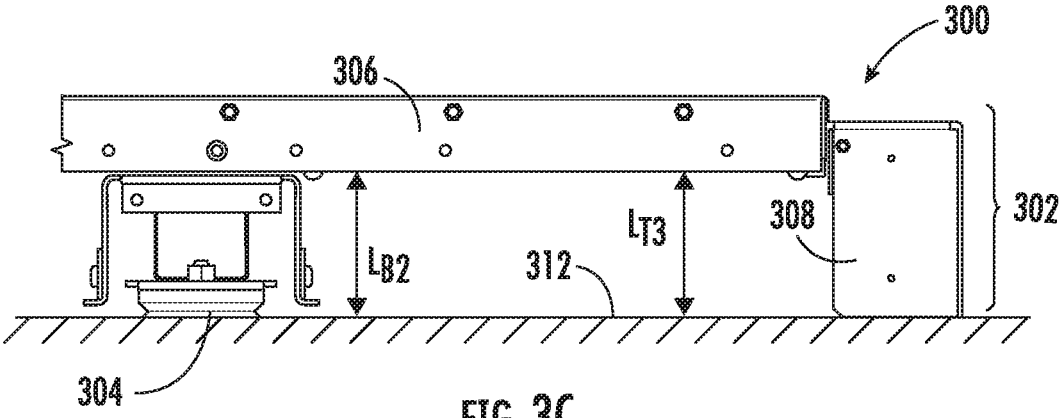
FIG. 3C is a schematic illustration of the elevator toe guard assembly of FIG. 3A shown in a third state.

For example, turning to FIGS. 3A-3C, schematic illustrations of an elevator toe guard assembly 300 in accordance with an embodiment of the present disclosure are shown. FIG. 3A illustrates the elevator toe guard assembly 300 in a first state, FIG. 3B illustrates the elevator toe guard assembly 300 in a second state, and FIG. 3C illustrates the elevator toe guard assembly 300 in a third state. The elevator toe guard assembly 300 includes a toe guard 302 and a buffer 304. Each of the toe guard 302 and the buffer 304 are fixedly mounted to an elevator car frame 306, the elevator car frame 306 forming at least part of a bottom of an elevator car. The toe guard 302 may be positioned beneath an elevator car door (not shown) as described above. The buffer 304 may be mounted or affixed to the elevator car frame 306 at any given location, and the proximity shown in FIGS. 3A-3C between the toe guard 302 and the buffer 304 are shown merely for simplicity and illustrative purposes. Further, in some embodiments, multiple buffers may be arranged at different locations on the bottom of the elevator car.

The toe guard 302 includes a first element 308 and one or more second elements 310*a*, 310*b*, 310*c*, 310*d*, 310*e*. The second elements 310*a*, 310*b*, 310*c*, 310*d*, 310*e* may form a telescoping or telescopic toe guard structure, wherein in some states, one or more of the second elements 310*a*, 310*b*, 310*c*, 310*d*, 310*e* are moveable relative to the first element 308, and in some positions, one or more of the second elements 310*a*, 310*b*, 310*c*, 310*d*, 310*e* may be housed within one or more of the other second elements 310*a*, 310*b*, 310*c*, 310*d*, 310*e* and/or the first element 308.

FIG. 3A illustrates the toe guard 302 in a first state wherein all of the elements 308, 310*a*, 310*b*, 310*c*, 310*d*, 310*e* are extended to form a full size and fully extended toe guard to provide protection and safety, as described above. In some non-limiting embodiments, the toe guard 302, in the first state, extends a first toe guard length $L_{T1}$. In some embodiments, the first toe guard length $L_{T1}$ may be at least 750 mm in length. Also shown in FIG. 3A, the buffer 304 may extend a first buffer length $L_{B1}$. The first state shown in FIG. 3A may be a state that is activated in the event of an emergency and/or rescue operation.

FIG. 3B illustrates the toe guard 302 in a second state with one or more of the second elements 310*b*, 310*c*, 310*d*, 310*e* housed within another of the second elements 310*a* and/or within the first element 308. In some non-limiting embodiments, the toe guard 302, in the second state, extends a second toe guard length $L_{T2}$. In some embodiments, the second toe guard length $L_{T2}$ may be about 280 mm in length. Also shown in FIG. 3B, the buffer 304 may extend the first buffer length $L_{B1}$ when the toe guard 302 is in the second state. The second state may be a normal state of operation for the system, such that during operation of the elevator car within an elevator shaft, a minimum clearance distance $L_C$ is maintained between the toe guard 302 and a pit floor 312. In some embodiments, minimum clearance distance $L_C$ may be at least 20 mm.

During an emergency or rescue operation, in some embodiments, the toe guard 302 may be manually unlocked to extend from the second state (FIG. 3B) to the first state (FIG. 3A). In other embodiments, the extension may be automatic or electronic, depending on the specific configuration of the toe guard, as will be appreciated by those of skill in the art.

In normal operation (i.e., the second state, shown in FIG. 3B), a portion of the toe guard 302 is extended, but such extension is set such that the toe guard 302 does not contact the pit floor 312 when the elevator car is located at the lowest landing of an elevator shaft.

Turning to FIG. 3C, however, at times, the elevator car may travel beyond (lower than) the normal operating position shown in FIG. 3B, thus transitioning to the third state. In such instances, the buffer 304 may contact the pit floor 312 and compress to absorb impact energy. In such instances, however, as shown in FIG. 3B, if the elevator car travels downward toward the pit floor 312, at least a portion of the toe guard 302 may contact the pit floor 312. However, as shown in FIG. 3C, all second elements 310*a*-310*e* can be moved into the first element 308 of the toe guard 302 such that no (or minimal) damage may occur to the toe guard 302 during a pit floor impact. That is, as the second element 310*a* touches the pit floor 312, the second element 310*a* may slide into the first element 308, thus further reducing the dimensions of the toe guard 302 to a third toe guard length $L_{T3}$. To achieve this, in some non-limiting embodiments, the toe guard 302 may have a third toe guard length $L_{T3}$ of about 180 mm, which is less than the dimensions of the buffer 304 during a pit floor impact.

That is, as shown in FIG. 3C, the buffer 304 is compressed such that the buffer has a second buffer length $L_{B2}$. The second buffer length $L_{B2}$ is less than the first buffer length $L_{B1}$. Further, the third toe guard length $L_{T3}$ may be less than the second buffer length $L_{B2}$ such that in an impact event, the buffer 304 is the primary component that contacts the pit floor 312 and the toe guard 302 does not contact the pit floor 312 in an damaging manner. It will be appreciated that during an impact event, the pit floor 312 may force one or more second elements 310*a*-310*e* to move into the first element 308, but minimal to no damage will occur to the toe guard 302 because the buffer 304 will absorb the impact with the pit floor 312.

Figure 4A:
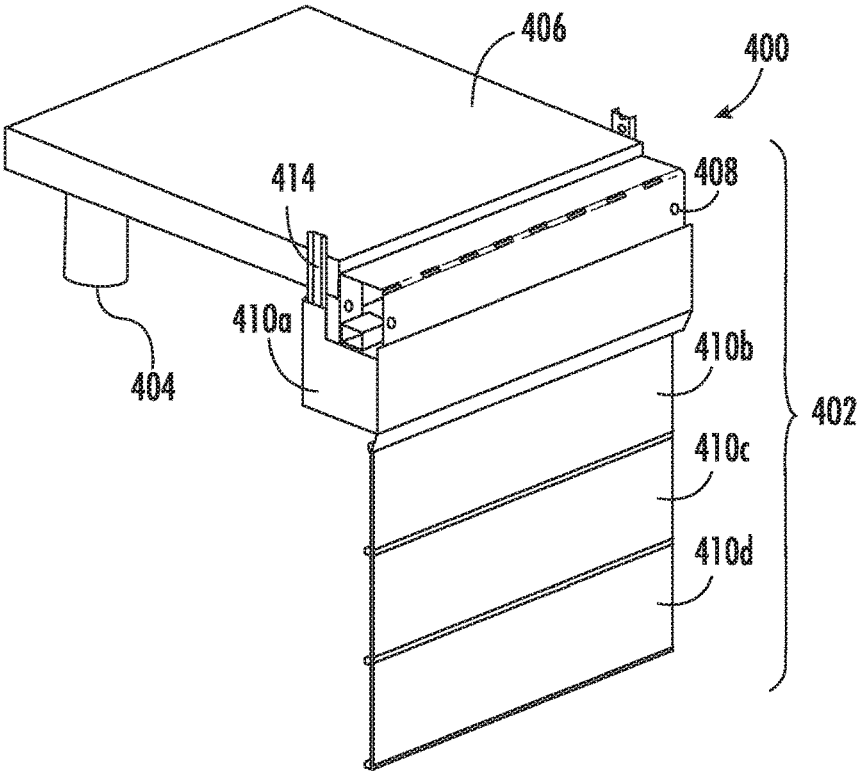
FIG. 4A is a schematic illustration of an elevator toe guard assembly in accordance with an embodiment of the present disclosure, shown in a first state.
Figure 4B:
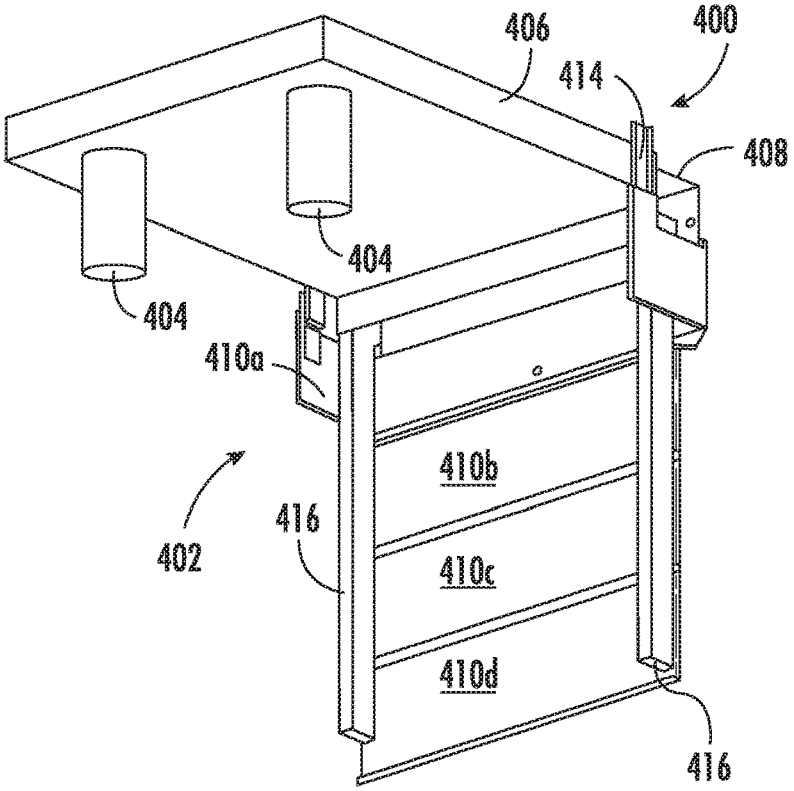
FIG. 4B is another schematic illustration of the elevator toe guard assembly of FIG. 4A.
Figure 4C:
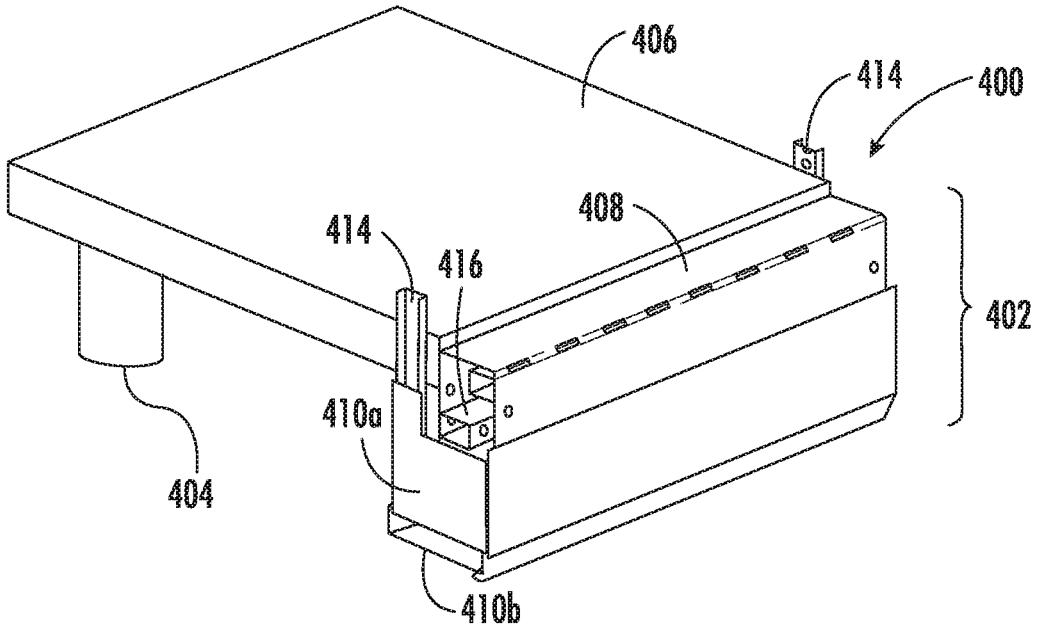
FIG. 4C is a schematic illustration of the elevator toe guard assembly of FIG. 4A shown in a second state.
Figure 4D:
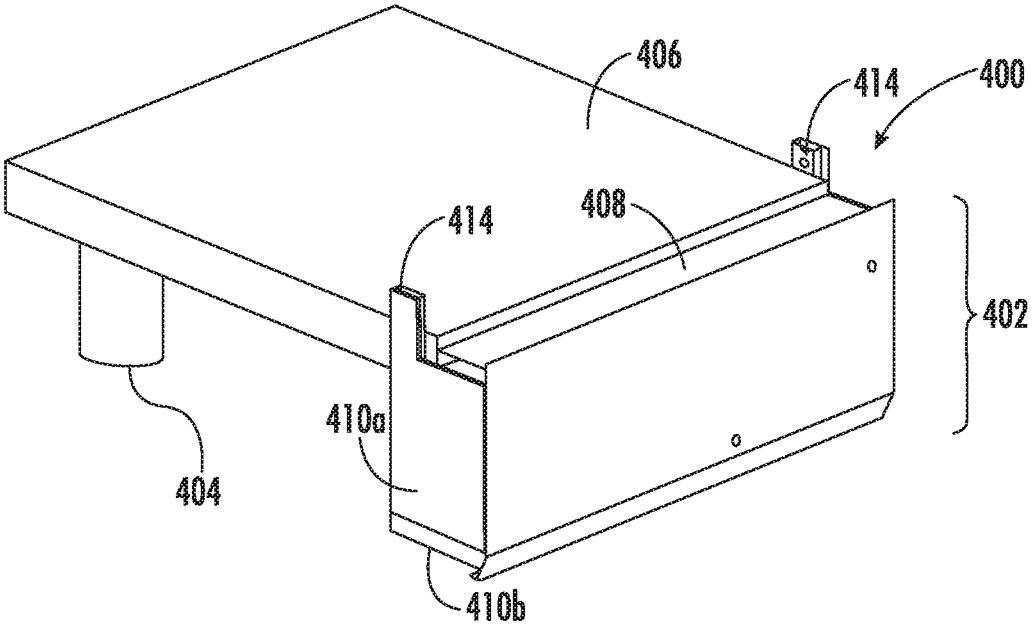
FIG. 4D is a schematic illustration of the elevator toe guard assembly of FIG. 4A shown in a third state.

Turning now to FIGS. 4A-4D, schematic illustrations of an elevator toe guard assembly 400 in accordance with an embodiment of the present disclosure are shown. FIGS. 4A-4B illustrate the elevator toe guard assembly 400 in a first state, FIG. 4C illustrates the elevator toe guard assembly 400 in a second state, and FIG. 4D illustrates the elevator toe guard assembly 400 in a third state. The elevator toe guard assembly 400 includes a toe guard 402 and, in this embodiment, multiple buffers 404. Each of the toe guard 402 and the buffers 404 are fixedly mounted to an elevator car frame 406, the elevator car frame 406 forming at least part of a bottom of an elevator car. The toe guard 402 may be positioned beneath an elevator car door (not shown) as described above. The buffers 404 may be mounted or affixed to the elevator car frame 406 at any given location, and the proximity shown in FIGS. 4A-4D between the toe guard 402 and the buffer 404 are shown merely for simplicity and illustrative purposes. Further, in some embodiments, multiple buffers may be arranged at different locations on the bottom of the elevator car.

The toe guard 402 includes a first element 408 and one or more second elements 410*a*, 410*b*, 410*c*, 410*d*. The second elements 410*a*, 410*b*, 410*c*, 410*d* may form a folding toe guard structure, wherein in some states, one or more of the second elements 410*a*, 410*b*, 410*c*, 410*d* are moveable relative to the first element 408, and in some positions, one or more of the second elements 410*a*, 410*b*, 410*c*, 410*d* may be housed within one or more of the other second elements 410*a*, 410*b*, 410*c*, 410*d* and/or the first element 408. In this embodiment, the one or more of the second elements 410*b*, 410*c*, 410*d* of the toe guard 402 are folding panels that can be folded into a stored state within the first of the second elements 410*a*. The first of the second elements 410*a* is moveable relative to the first element 408.

FIGS. 4A-4B illustrate the toe guard 402 in a first state wherein all of the elements 408, 410*a*, 410*b*, 410*c*, 410*d* are extended to form a full size and fully extended toe guard to provide protection and safety, as described above. In some non-limiting embodiments, the toe guard 402, in the first state, extends a first toe guard length, similar to that shown and described above. In some embodiments, the first toe guard length may be at least 750 mm in length. Further, similar to that described above, the buffer 404 may extend a first buffer length. The first state shown in FIGS. 4A-4B may be a state that is activated in the event of an emergency and/or rescue operation.

In this embodiment, the first element 408 is fixed to the elevator car frame 406 and the first of the second elements 410*a* is moveable relative to the first element 408 in a sliding manner. As shown, the first of the second elements 410*a* is movably connected to the elevator car frame 406 (or the first element 408) by a sliding mount 414. The sliding mount 414 allows for the second elements 410*a*, 410*b*, 410*c*, 410*d* to move relative to the first element 408, as described herein. Further, as shown, the toe guard 402 includes one or more structural supports 416. The structural supports 416 are arranged to provide support and rigidity to one or more of the second elements 410*a*, 410*b*, 410*c*, 410*d*, when in the first state. The structural supports 416 may be foldable or moveable such that the structural supports 416 can be stored or stowed within the first element 408 during a normal mode of operation.

FIG. 4C illustrates the toe guard 402 in a second state with one or more of the second elements 410*b*, 410*c*, 410*d* housed within another of the second elements 410*a* and/or within the first element 408. In some non-limiting embodiments, the toe guard 402, in the second state, extends a second toe guard length, as described above. In some embodiments, the second toe guard length may be about 280 mm in length. Also shown in FIG. 4C, the buffer 404 may extend the first buffer length when the toe guard 402 is in the second state. The second state may be a normal state of operation for the system, such that during operation of the elevator car within an elevator shaft, a minimum clearance distance is maintained between the toe guard 402 and a pit floor, as described above. In some embodiments, minimum clearance distance may be at least 20 mm.

During an emergency or rescue operation, in some embodiments, the toe guard 402 may be manually unlocked to extend from the second state (FIG. 4C) to the first state (FIGS. 4A-4B). In other embodiments, the extension may be automatic or electronic, depending on the specific configuration of the toe guard, as will be appreciated by those of skill in the art.

In normal operation (i.e., the second state, shown in FIG. 4C), a portion of the toe guard 402 is extended, but such extension is set such that the toe guard 402 does not contact the pit floor when the elevator car is located at the lowest landing of an elevator shaft.

Turning to FIG. 4D, however, at times, the elevator car may travel beyond (lower than) the normal operating position shown in FIG. 4C. In such instances, the buffer 404 may contact a pit floor and compress to absorb impact energy. Similar to the above described embodiment, if the elevator car travels downward toward the pit floor, at least a portion of the toe guard 402 may contact the pit floor. However, as shown in FIG. 4D, the second elements 410*a*-410*d* are moved relative to the first element 408 such that no (or minimal) damage may occur to the toe guard 402 during a pit floor impact. That is, as the second element 410*a* touches the pit floor, the second element 410*a* will slide along the sliding mount 414 and relative to the first element 408, thus further reducing the dimensions of the toe guard 402 to a third toe guard length.

Figure 5A:
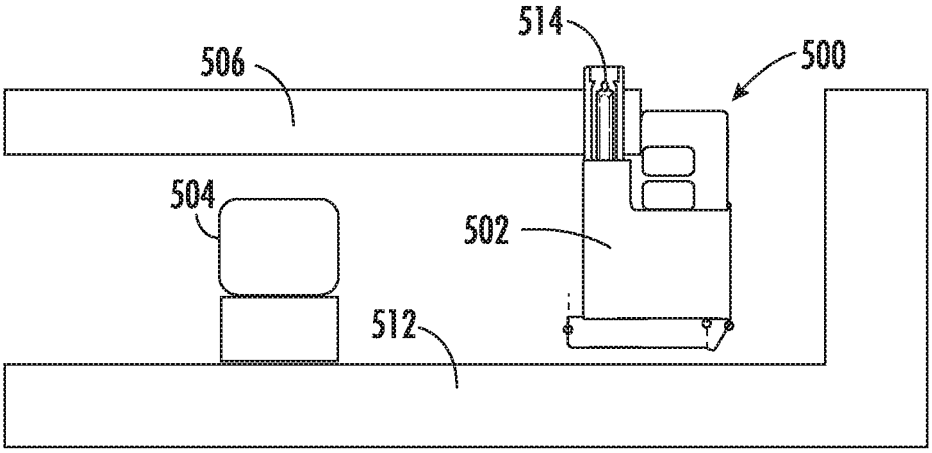
FIG. 5A is a schematic illustration of an elevator toe guard assembly shown in a second state.
Figure 5B:
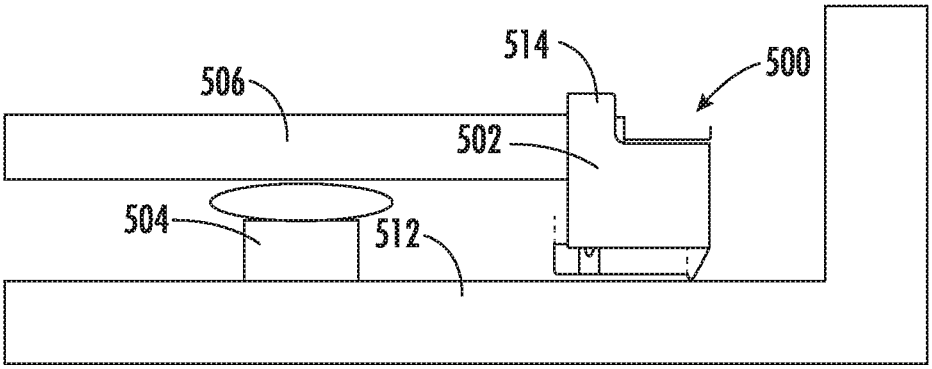
FIG. 5B is a schematic illustration of the elevator toe guard assembly of FIG. 5A shown in a third state.

Turning to FIGS. 5A-5B, schematic illustrations of a second state (FIG. 5A) and third state (FIG. 5B) of an elevator toe guard assembly 500 in accordance with an embodiment of the present disclosure are shown. The elevator toe guard assembly 500 (particularly a toe guard 502 thereof) may be similar to that shown and described with respect to FIGS. 4A-4D, and thus detailed description of various parts may be omitted.

As noted, FIG. 5A illustrates the second state of the elevator toe guard assembly 500, and particularly the second state of a toe guard 502 that is mounted to an elevator car frame 506. In contrast to the illustrative embodiment of FIGS. 4A-4D, in the present embodiment, a buffer 504 is mounted or affixed to a pit floor 512 (e.g., similar to the arrangement of FIG. 1). As shown in FIG. 5A, the toe guard 502 is in a partially extended state such that it extends over or beyond the length of the buffer 504. In the third state, shown in FIG. 5B, a buffer impact event has occurred wherein the buffer 504 is fully compressed. In this event, the toe guard 502 has moved along a sliding mount 514 to prevent damage to the toe guard 502.

As will be appreciated by those of skill in the art, the buffers of the present disclosure may be mounted to elevator cars, pit floors, guide rails, other structural elements located within a pit, and/or combinations thereof. Thus, the present illustrations are merely for illustrative and explanatory purposes and are not intended to be limiting.

Advantageously, embodiments of the present disclosure allow for a reduction in car toe guard height in normal modes of operation and for impact events the buffer and toe guard may be configured to optimize safety while minimizing damage to one or more components of the elevator system. During an emergency event (e.g., a rescue), the height of the car toe guard could be extended from, for example, 280 mm to 750 mm. Advantageously, the height of the toe guard may not be linked to car position or a car positioning system, as will be appreciated by those of skill in the art for typical arrangements.

As noted, during normal modes of operation, including buffer impacts, the car toe guard may be set at a reduced size, e.g., a total height of about 280 mm, which is compatible with reduced pit depths of some new elevator system configurations, (e.g., a pit depth of 300 mm). In such normal operation, the toe guard will not touch the pit floor even at lowest landing. The vertical telescopic parts of the toe guard may be stowed such that is protected in the event of car buffer impacts, as shown and described above. Further, advantageously, embodiments provided herein can enable the suppression of noise and vibration that may occur due to a car toe guard contacting a pit floor when the elevator car reaches the lowest landing.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the spirit and scope of the present disclosure. Additionally, while various embodiments of the present disclosure have been described, it is to be understood that aspects of the present disclosure may include only some of the described embodiments.

Accordingly, the present disclosure is not to be seen as limited by the foregoing description, but is only limited by the scope of the appended claims.

What is claimed is:

1. An elevator toe guard assembly comprising:
an elevator car frame;
a buffer located within an elevator shaft; and
a toe guard mounted to the elevator car frame,
wherein the toe guard has:
a first state being a fully extended state,
a second state wherein the toe guard is partially extended to prevent contact a pit floor during normal operation of an elevator car when the elevator car is located at a lowest landing along the elevator shaft and the partially extended toe guard of the second state is extended for a length greater than a length of the buffer, and
a third state wherein at least a portion of the toe guard is moved relative to the elevator car frame during an impact between the buffer and the pit floor.

2. The elevator toe guard assembly of claim 1, wherein the toe guard comprises a first element and at least one second element, wherein the at least one second element is moveable during the impact between the buffer and the pit floor.

3. The elevator toe guard assembly of claim 2, wherein the first element is fixedly connected to the elevator car frame.

4. The elevator toe guard assembly of claim 3, wherein the at least one second element comprises a plurality of second elements forming a telescopic toe guard.

5. The elevator toe guard assembly of claim 3, wherein the at least one second element comprises a plurality of second elements forming a folding toe guard.

6. The elevator toe guard assembly of claim 2, wherein the at least one second element comprises a plurality of second elements forming a telescopic toe guard.

7. The elevator toe guard assembly of claim 2, wherein the at least one second element comprises a plurality of second elements forming a folding toe guard.

8. The elevator toe guard assembly of claim 7, further comprising a sliding mount, wherein at least one second element is slidably mounted to at least one of the elevator car frame and the first element by the sliding mount.

9. The elevator toe guard assembly of claim 8, further comprising at least one structural support arranged to support at least one second element when the toe guard is in the first state.

10. The elevator toe guard assembly of claim 7, further comprising at least one structural support arranged to support at least one second element when the toe guard is in the first state.

11. The elevator toe guard assembly of claim 1, wherein, when in the first state, the toe guard extends at least 750 mm from the elevator car frame.

12. The elevator toe guard assembly of claim 1, wherein when in the second state, the toe guard extends about 280 mm from the elevator car frame.

13. The elevator toe guard assembly of claim 1, wherein when in the second state, the toe guard maintains a minimum clearance distance between the toe guard and the pit floor.

14. The elevator toe guard assembly of claim 13, wherein the minimum clearance distance is about 20 mm.

15. The elevator toe guard assembly of claim 1, wherein the toe guard is about 180 mm in length when in the third state.

16. The elevator toe guard assembly of claim 1, wherein the buffer is mounted to the elevator car frame.

17. The elevator toe guard assembly of claim 1, wherein the toe guard is manually operable from the second state to the first state.

18. The elevator toe guard assembly of claim 1, wherein the buffer is located proximate an elevator pit floor.

* * * * *